US009057253B2

(12) United States Patent
Moffitt

(10) Patent No.: US 9,057,253 B2
(45) Date of Patent: Jun. 16, 2015

(54) LINER TOP PACKER FOR LINER DRILLING

(75) Inventor: Michael Eric Moffitt, Kingwood, TX (US)

(73) Assignee: Schlumberber Technology Corporation, Sugar Land, TX (US)

( * ) Notice: Subject to any disclaimer, the term of this patent is extended or adjusted under 35 U.S.C. 154(b) by 352 days.

(21) Appl. No.: 13/529,400

(22) Filed: Jun. 21, 2012

(65) Prior Publication Data

US 2012/0325499 A1 Dec. 27, 2012

Related U.S. Application Data

(60) Provisional application No. 61/499,606, filed on Jun. 21, 2011.

(51) Int. Cl.

| | |
|---|---|
| ***E21B 33/12*** | (2006.01) |
| ***E21B 43/10*** | (2006.01) |
| ***E21B 23/06*** | (2006.01) |
| ***E21B 33/128*** | (2006.01) |
| ***E21B 7/20*** | (2006.01) |

(52) U.S. Cl.

CPC ..... *E21B 43/10* (2013.01); *E21B 23/06* (2013.01); *E21B 33/1285* (2013.01); *E21B 7/20* (2013.01)

(58) Field of Classification Search

USPC ..... 166/382, 208, 120, 377, 383, 123, 125, 166/181, 212, 387, 207, 282

See application file for complete search history.

(56) References Cited

U.S. PATENT DOCUMENTS

| | | | | |
|---|---|---|---|---|
| 5,887,660 | A * | 3/1999 | Yokley et al. | 166/386 |
| 7,798,251 | B2 | 9/2010 | Eriksen et al. | |
| 2004/0216877 | A1* | 11/2004 | Pedersen et al. | 166/285 |
| 2011/0203794 | A1 | 8/2011 | Moffitt et al. | |

OTHER PUBLICATIONS

Tesco Casing Drilling, Tesco Corporation, Apr. 2008, 12 pgs.

International Preliminary Report on Patentability/Written Opinion issued Jan. 9, 2014 in corresponding International application No. PCT/US2012/043611 (7 pages).

* cited by examiner

*Primary Examiner* — David Andrews
*Assistant Examiner* — Taras P Bemko
(74) *Attorney, Agent, or Firm* — Osha Liang LLP

(57) ABSTRACT

A liner top packer is configured to be secured in a liner string, such as in a liner drilling operation. The packer is actuated from within the liner or packer body. An actuator assembly includes an inner piston, an actuator housing, and an outer piston. A tubular setting tool is moved upwardly through the inner piston, and dogs on the setting tool allow for force to be applied to the inner piston, pressurizing fluid and forcing it to the outer piston to compress a pack off element. The actuator assembly is removed by upward force applied by a foot of the setting tool on the inner piston, the actuator housing, or any other component of the actuator assembly.

12 Claims, 3 Drawing Sheets

LINER TOP PACKER FOR LINER DRILLING

CROSS-REFERENCE TO RELATED APPLICATION

This application claims priority from U.S. Provisional Patent Application Ser. No. 61/499,606, entitled "Liner Top Packer for Liner Drilling," filed Jun. 21, 2011, which is incorporated herein by reference in its entirety.

BACKGROUND

The invention relates generally to the field of drilling and processing of wells, and particularly to techniques for sealing a liner within a casing during liner drilling.

Casing drilling and liner drilling have increasingly become important in the field of oil and gas exploration and production. In contrast to conventional drilling operations, casing and liner drilling involve creating and advancing a bore hole through horizons of possible interest by means of a bottom hole assembly, including a drill bit, attached to a casing or liner string. The casing and/or liner maintain the integrity of the bore hole, reduce the number of run-ins required to position and cement the casing and liner, and can more effectively and efficiently move from drilling to production.

Casing and liner drilling pose unique challenges due to the nature of the equipment and components used. For example, in conventional drilling operations, when a tubular member is to be sealed to a surrounding element, such as the borehole casing, a packer is typically employed. When used to seal (or pack off) a liner within a casing, for example, various packer designs may be employed that are actuated mechanically or hydraulically to force one or more packing elements to be forced into tight engagement between the tubing and the casing inner surface. In such operations, because a liner hanger used to hold the liner in place is itself a pressure containing vessel, a liner top packer may be used above the liner hanger.

In liner drilling, however, the liner hanger may not be desired to operate as a pressure vessel. The packer must therefore reside in the system below the hanger. Moreover, actuation of a conventional liner top packer is typically performed by setting a working tool string down on the packer to apply set-down weight to set the packer. However, with the packer integral to the liner string for liner drilling, this type of setting operation is not available.

There is a need, therefore, for novel arrangements and methods that allow for setting of a packer in a liner drilling tubular string. There is a particular need for a technique that may allow for setting a packer below a liner hanger, and that can be actuated internally to force a packing element into engagement between a liner string and a surrounding casing or liner.

BRIEF DESCRIPTION

The present invention is designed to respond to such needs. In accordance with one aspect of the invention, a liner top packer system comprises a packer body configured to be secured in a liner string, a pack off element secured to an outer periphery of the packer body, and an actuator assembly having an inner piston and an actuator housing disposed in the packer body, and an outer piston. A packer setting tool is disposed at least partially within the packer body and configured to cause movement of the inner piston to transmit fluid to the outer piston through the actuator housing to cause compression of the pack off element to set the pack off element in a casing.

In accordance with another aspect of the invention, a liner top packer system comprises a liner string disposed in a well casing, a liner hanger configured to hang the liner string in the casing, and a packer body coupled in the liner string below the liner hanger. A pack off element is secured to an outer periphery of the packer body. An actuator assembly is disposed at least partially within the packer body and configured to compress the pack off element when actuated. A packer setting tool is disposed within the packer body and configured to actuate the actuator assembly from within the packer body.

The invention also provides a liner pack-off method. In one embodiment, the method comprises composing a liner string comprising a liner hanger and a packer body below the liner hanger, and hanging the liner string in a casing via the liner hanger. An actuator assembly is then actuated from within the packer body via a packer setting tool disposed at least partially within the packer body to compress a pack off element secured to an outer periphery of the packer body.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present invention provides novel packing systems and methods that can be used in casing and liner drilling operations. The techniques allow for the use of either rotational or set-down force to set the packer, depending upon the design. This is accomplished through the use of a packer setting tool that is keyed or linked to the packer body or actuator housing. Once weight or rotation is applied to the actuator, hydraulic fluid is used to transmit pressure to a packer setting cylinder or volume, causing compression and setting of the liner top packer. The setting tool is then released and pulled back to the surface as part of the liner running tool assembly.

Figure 1:
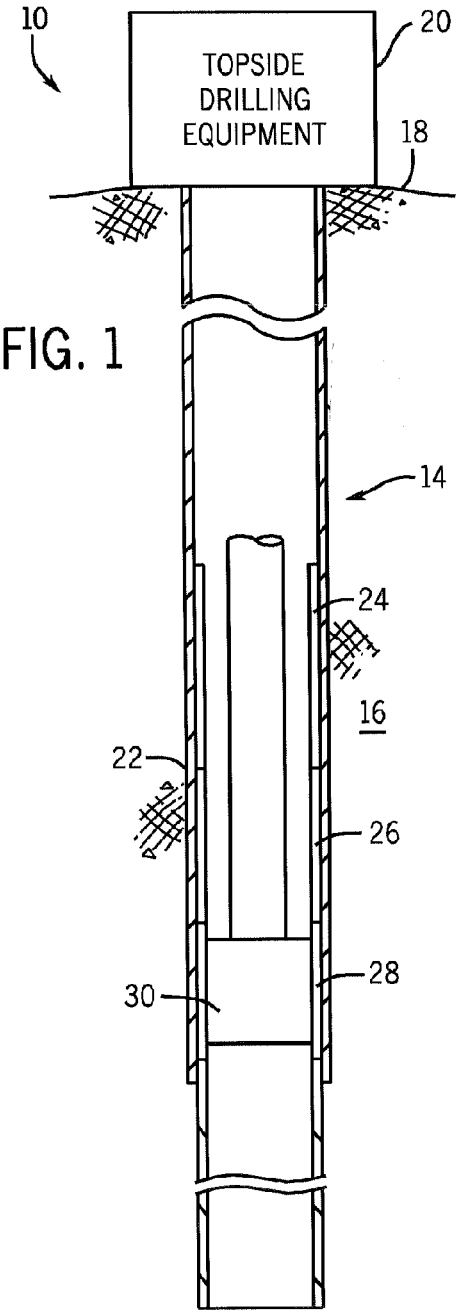
FIG. 1 is a simplified diagrammatical illustration of certain exemplary functional components of a liner drilling system, including a liner packer in accordance with the present techniques.

FIG. 1 is a simplified illustration of certain exemplary components that may be utilized in a system employing the present liner top packing scheme. The liner drilling system, designated generally by the reference numeral 10, comprises a casing (which itself may consist of a length of casing and one or more lengths of liner), positioned in a borehole 14. The borehole traversed one or more formations of possible interest in the Earth 16. The borehole extends from the surface 18, above which topside drilling equipment 20 is positioned. The drilling equipment will be operatively coupled to a liner string 22 for rotating, lowering, lifting and generally manipulating the liner string for drilling and other well formation and preparation operations.

It should be noted that the illustration of FIG. 1 is intentionally simplified to focus on the packing system described below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform, and some of the components used may be positioned at or near a point where the well enters the Earth at the bottom of a body of water.

The exemplary system of FIG. 1 also includes a liner hanger 24 for securing the liner within a surrounding tubular, such as the casing (or another length of liner). A polished bore receptacle 26 may be positioned below the hanger, and a packer 28 is positioned near the top of a lower liner section, for sealing the liner to the casing (or surrounding liner). A packer setting tool 30 is positioned within the packer and allows for setting the packer and withdrawing components comprising the setting tool as described below.

Figure 2:
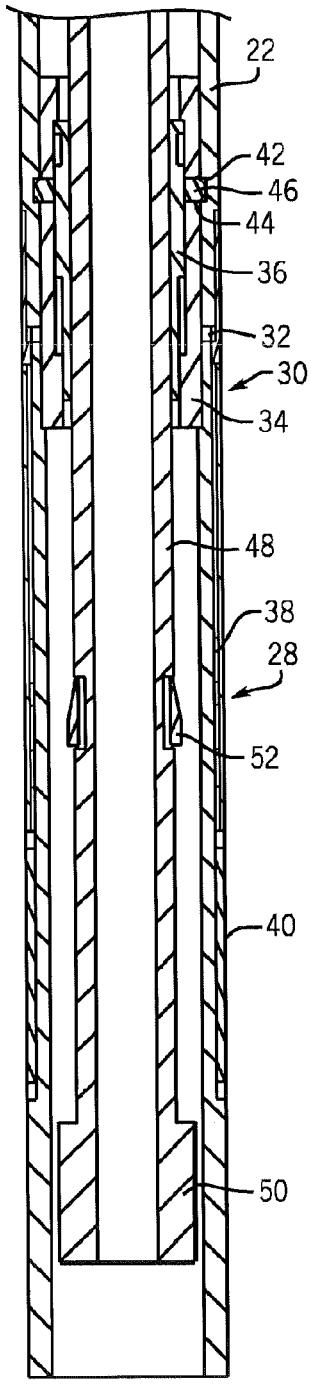
FIG. 2 is a sectional view of an exemplary liner top packer system during deployment and prior to setting of the packer.

FIG. 2 is a sectional view of an exemplary liner top packer and setting tool for use in a liner drilling system of the type illustrated in FIG. 1. The setting tool includes an outer piston 32 disposed about an actuator housing 34. An inner piston 36 is disposed within the housing. A cylindrical outer member (cylinder) 38 extends between the outer piston 32 and a pack off member 40. The pack off member itself will comprise one or more annular rings that can be compressed by the setting tool to force the pack off member outward to occupy an annular space between the liner (or packer body which forms part of the liner string) and a surrounding casing or liner (not shown). It should be noted that components of the liner top packer and the setting tool cooperate to allow for setting of the pack off member, and that this close cooperative relationship implies that certain components of the liner top packer and the setting tool may be considered as either part of one or the other assembly. In general, the liner body, the cylinder, the pack off member, and certain other hardware will be left in place within the liner string, while other components will be removed following setting of the packer. It should also be noted that reference may be made to the packer body as the liner insomuch as the packer body will be secured in the liner string and serve as part of the liner.

In the illustrated embodiment, the liner 22 (or packer body) has one or more internal recesses 42 formed around its inner surface, while the actuator housing 34 has corresponding recesses 44 formed around its outer surface. Dogs 46 are positioned within these recesses, and serve, during deployment of the packer, to detachably link the liner and the actuator housing to one another. In a presently contemplated embodiment, the dogs are urged into outward engagement with the liner to secure the actuator housing in place with respect to the liner. Functionally, the dogs aid in latching the actuator housing to the liner (or packer body) during placement of the packer. Moreover, as described below, the dogs resist upward forces on the inner components of the packer setting tool as the tool is moved upwardly from the position illustrated in FIG. 2.

The packer setting tool further comprises a tubular setting tool 48 that is part of a work string that extends to or can be manipulated from the surface. This setting tool 48 terminates in an enlarged foot 50 that aids in setting and/or retraction of the packer setting tool components, as described below. Finally, setting dogs 52 are provided around the periphery of the tubular setting tool 48. These dogs have a generally horizontal lower surface and a tapered upper surface, and may be biased into the radially extended position shown.

Figure 3:
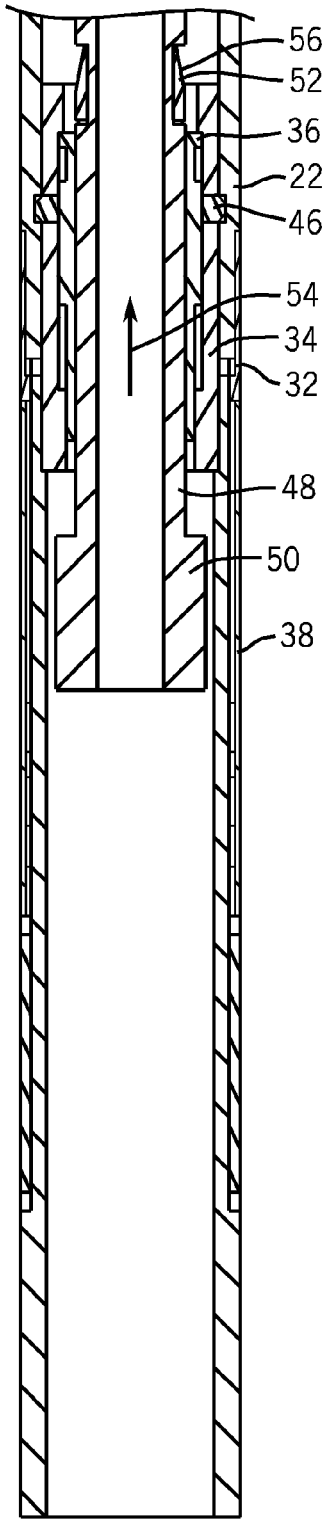
FIG. 3 is a sectional view of the exemplary liner top packer system following deployment and just prior to setting of the packer.

FIG. 3 illustrates an exemplary position of these packer and setting tool components just prior to setting of the packer. As shown, the tubular packer setting tool is raised through the actuator housing and inner piston as indicated by arrow 54. Owing to the upper taper on the setting dogs 52, the dogs are forced inwardly by contact with the actuator housing and/or the inner piston (or any other mechanical component of the packer setting tool). In the illustrated embodiment, the dogs 46 between the actuator housing 34 and the liner 22 (or packer body) resist upward forces on the actuator housing that might result from forces needed to collapse the setting dogs and to move them upwardly through the setting tool. Once above the actuator housing and inner piston, the dogs will re-extend radially from their inwardly collapsed position 56 shown.

Figure 4:
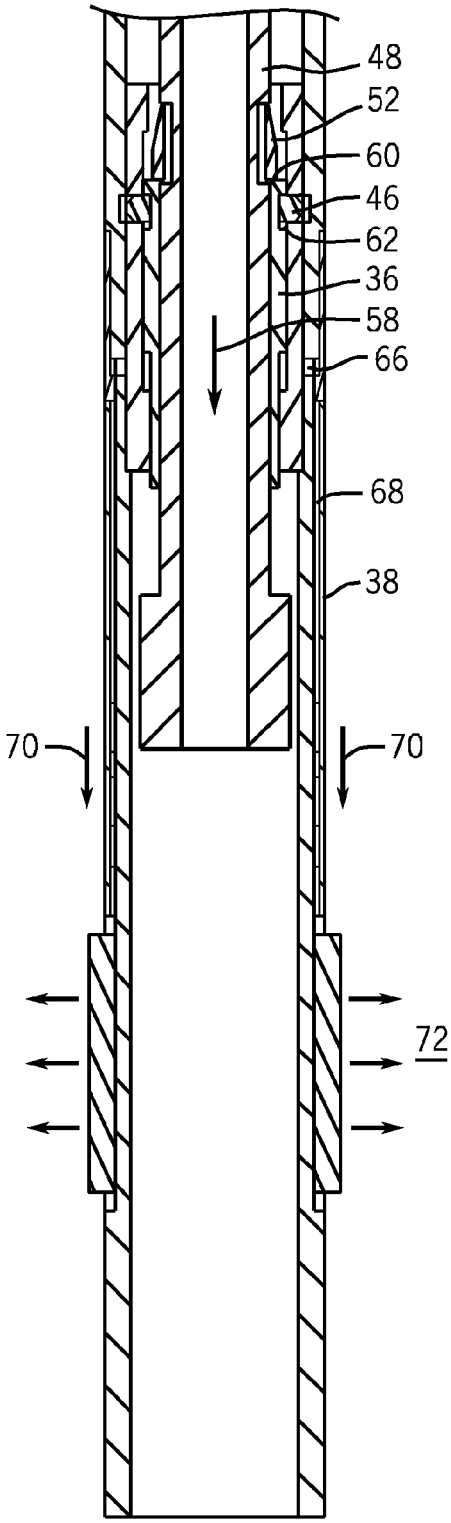
FIG. 4 is a sectional view of the exemplary liner top packer system during setting of the packer.

FIG. 4 illustrates the packer and setting tool as the packer is set. In the illustrated embodiment, the packer is set by translational (e.g., downward) movement of the tubular setting tool 48, as indicated by arrow 58. This movement causes the lower surface of the setting dogs 52 to contact the inner piston 36. Further movement of the tubular setting tool forces downward movement of the inner piston 36. The outer surface of the inner piston includes recesses 42 that will ultimately align with the dogs 46 as discussed below. A fluid cavity between the inner piston and the actuator body, which is or comes into fluid communication with one or more passages 66 through the actuator housing provides for fluid to be forced through the passages into an annular cavity 68 between the liner (or packer body) and the cylinder 38. Fluid may be trapped in these fluid cavities or may be communicated from the surface, such that a higher pressure is developed that urges the outer piston 32 and cylinder downwardly, as indicated by reference numeral 70. This force compresses the pack off element, forcing it outwardly as indicated by reference numeral 72. Ratcheting elements are provided between the cylinder and the pack off element that hold the pack off element firmly compressed following relieving of pressure from the outer piston, and subsequent removal of the packer setting tool.

Figure 5:
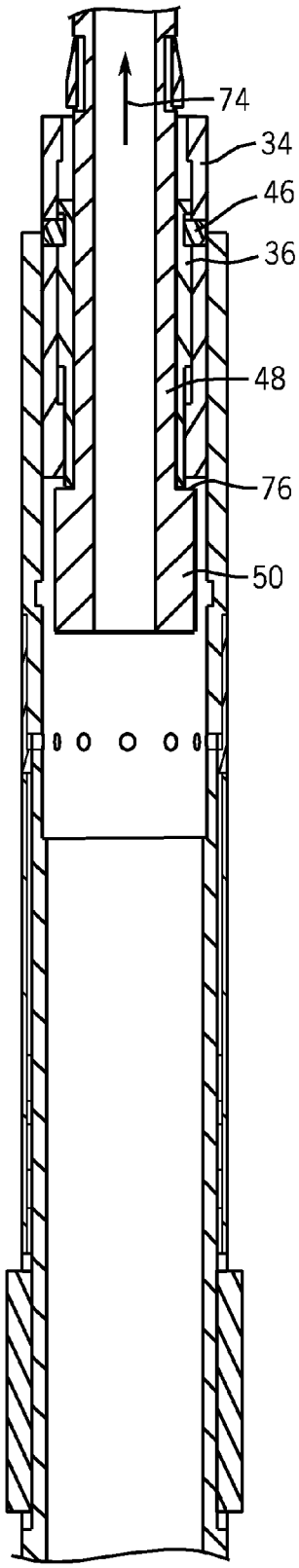
FIG. 5 is a sectional view of the exemplary liner top packer system following setting of the packer and during retrieval of the packer setting tool.

The packer setting tool may then be removed as illustrated in FIG. 5. As noted above, as the inner piston was moved downwardly, recesses 62 formed in its outer surface align with dogs 46, which then enter into these recesses, such that the dogs then span the inner piston recesses 62 and the recesses 42 of the actuator housing 34. As shown in FIG. 5, then, upward movement of the tubular setting tool 48, as indicated by arrow 74, causes an upper surface 76 of the foot 50 to contact the lower extremity of the inner piston 36, the actuator housing 34 or both. These are then made to slide upwardly with the tubular setting tool for extraction of the setting components, as shown.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A liner top packer system comprising:

a packer body configured to be secured in a liner string;

a pack off element secured to an outer periphery of the packer body;

an actuator assembly having an inner piston and an actuator housing disposed in the packer body, and an outer piston; and a packer setting tool disposed at least partially within the packer body and configured to cause movement of the inner piston to transmit fluid to the outer piston through the actuator housing to cause compression of the pack off element to set the pack off element in a casing, wherein the actuator housing comprises first dog recesses and the packer body comprises second dog recesses, and wherein the system further comprises dogs disposed in first and second dog recesses to couple the actuator housing within the packer body during deployment of the system, and wherein the inner piston comprises third dog recesses, the dogs being received in the first dog recesses of the actuator housing and the third dog recesses of the inner piston for extraction of the actuator assembly from the packer body following actuation of the actuator assembly.

2. The liner top packer system of claim 1, wherein the packer setting tool comprises setting dogs extending from an outer surface thereof, the setting dogs being engageable with the inner piston to cause downward movement of the inner piston by downward force on the packer setting tool.

3. The liner top packer system of claim 2, wherein the setting dogs are disposed below the actuator assembly during deployment of the system, and are configured to pass through the inner piston for positioning above the inner piston for actuation of the actuator assembly.

4. The liner top packer system of claim 3, wherein the setting dogs are urged radially outwardly, and have tapered upper surfaces to cause the setting dogs to be collapsed radially inwardly for passage through the inner piston.

5. The liner top packer system of claim 1, wherein the packer setting tool comprises a lower enlarged section that contacts the inner piston, the actuator housing, or both for extraction of the actuator assembly from the packer body following setting of the pack off element.

6. The liner top packer system of claim 1, wherein the system is configured to be disposed in a liner string below a liner hanger.

7. A liner top packer system comprising:

a liner string disposed in, a well casing;

a liner hanger configured to hang the liner string in the casing;

a packer body coupled in the liner string below the liner hanger;

a pack off element secured to an outer periphery of the packer body;

an actuator assembly disposed at least partially within the packer body and configured to compress the pack off element when actuated, wherein the actuator assembly comprises an inner piston and an actuator housing disposed in the packer body, and an outer piston; and a packer setting tool disposed within the packer body and configured to actuate the actuator assembly from within the packer body, wherein the actuator housing comprises first dog recesses and the packer body comprises second dog recesses, and wherein the system further comprises dogs disposed in first and second dog recesses to couple the actuator housing within the packer body during deployment of the system, and wherein the inner piston comprises third dog recesses, the dogs being received in the first dog recesses of the actuator housing and the third dog recesses of the inner piston for extraction of the actuator assembly from the packer body following actuation of the actuator assembly.

8. The liner top packer system of claim 7, wherein the packer setting tool is configured to cause movement of the inner piston to transmit fluid to the outer piston through the actuator housing to cause compression of the pack off element to set the pack off element in a casing.

9. The liner top packer system of claim 8, wherein the packer setting tool comprises setting dogs extending from an outer surface thereof, the setting dogs being engageable with the inner piston to cause movement of the inner piston by downward force on the packer setting tool.

10. The liner top packer system of claim 9, wherein the setting dogs are disposed below the actuator assembly during deployment of the system, and are configured to pass through the inner piston for positioning above the inner piston for actuation of the actuator assembly.

11. The liner top packer system of claim 10, wherein the setting dogs are urged radially outwardly, and have tapered upper surfaces to cause the setting dogs to be collapsed radially inwardly for passage through the inner piston.

12. The liner top packer system of claim 7, wherein the packer setting tool comprises a lower enlarged section that contacts the actuator assembly for extraction of the actuator assembly from the packer body following actuation of the actuator assembly.

* * * * *